United States Patent [19]

Hagar

[11] Patent Number: 5,038,849

[45] Date of Patent: Aug. 13, 1991

[54] SEALING OF AIR HEATERS BY DEFORMING SECTOR PLATES

[75] Inventor: Donald K. Hagar, Emmaus, Pa.

[73] Assignee: Damper Design, Inc., Lehigh Valley, Pa.

[21] Appl. No.: 425,925

[22] Filed: Oct. 24, 1989

[51] Int. Cl.[5] ..... F28D 19/02

[52] U.S. Cl. ..... 165/9; 165/8

[58] Field of Search ..... 165/9, 8, 4

[56] References Cited

U.S. PATENT DOCUMENTS

| | | | |
|---|---|---|---|
| 2,732,184 | 1/1956 | Ballard et al. | 168/9 |
| 3,157,226 | 11/1964 | Atwood | 165/9 |
| 3,250,316 | 5/1966 | Nyberg | 165/9 |
| 3,786,868 | 1/1974 | Finnemore | 168/9 |
| 4,024,907 | 5/1977 | Brzytwa | 165/9 |
| 4,040,475 | 8/1977 | Stockman et al. | 165/9 |
| 4,122,891 | 10/1978 | Baker | 165/9 |
| 4,124,063 | 11/1978 | Stockman | 165/9 |
| 4,219,069 | 8/1980 | Stockman . | |
| 4,298,055 | 11/1981 | Ritter | 165/9 |
| 4,301,858 | 11/1981 | Mock | 165/9 |
| 4,313,489 | 2/1982 | Stockman | 165/9 |
| 4,421,157 | 12/1983 | Sandmann . | |
| 4,760,875 | 8/1988 | Gibson et al. | 165/9 |

FOREIGN PATENT DOCUMENTS

| | | | |
|---|---|---|---|
| 10944 | 1/1977 | Japan | 165/9 |

*Primary Examiner*—Albert W. Davis, Jr.
*Attorney, Agent, or Firm*—Foley & Lardner

[57] ABSTRACT

A sealing structure for an air preheater is provided for maintaining a constant clearance between the drum and deformable sector plates. Deflection governing struts or beams extend across the sector plates and bend in a manner which corresponds with the change in shape which the drum undergoes when its temperature changes. The outer ends of the struts are connected to an outer ring engaged with the drum via guides. As the drum deforms so that its ends assume approximately partial spherical curvatures in response to increased temperatures, the struts are likewise deformed. The deformation of the sector plates is controlled by the more rigid struts.

11 Claims, 8 Drawing Sheets

SEALING OF AIR HEATERS BY DEFORMING SECTOR PLATES

BACKGROUND OF THE INVENTION

1. Field of the Invention

This invention relates to sealing systems for air heaters and more particularly to a sealing system with a deformable sector plate for effecting seals between the portions of an air heater which move relative to each other.

2. Discussion of the Related Art

It is typical in fuel burning installations or devices, such as electrical power generating plants, to use regenerative air preheaters for heating the intake air to improve the efficiency of the fuel burning operation. These air preheaters typically include two major components, namely, a generally cylindrical drum having a matrix of heat exchanging elements therein and a surrounding housing having a generally cylindrical opening therein. One type of preheater has a stationary drum and a movable housing surrounding the drum. This type of air preheater is known as a Rothermuhle type air preheater, which is exemplified in U.S. Pat. No. 3,802,489 assigned to Apparatebau Rothermuhle Brandt & Kristzler of Wenden, West Germany, which patent is incorporated herein by reference. However, the most commonly used preheaters are those of the Ljungstrom type in which the drum is a cylindrical rotor containing metallic heat transfer plates, the rotor being movable with respect to a surrounding stationary housing. As the rotor turns, the heat transfer plates are first exposed to hot discharge gases, and these heated plates then move into the air intake passage to heat the incoming air. The housing surrounding the drum includes sector plates which divide the housing into an air intake half and gas discharge half. In an attempt to reduce the mingling of the two fluids, the drum is typically provided with radially extending seal plates that are intended to pass closely by the sector plates with only a small clearance.

A major problem with the foregoing sealing arrangement is that it depends on achieving small, constant and predictable clearances between the seal plates and adjacent surfaces. Such clearances are difficult to attain even in a newly manufactured air preheater, and are particularly difficult to maintain in an air preheater that is in service. Air preheaters, when in service, are subject to extremes in temperature and a very hostile environment. Factors such as wear, distortion of parts due to temperature differentials, normal dimensional changes due to heating and cooling, lack of flatness in the sector plates, out of roundness of the drum and/or adjacent housing portion, and various other factors contribute, in practice, to wide variation in the clearances between moving parts. One particular problem is that the drum and its seal plate tend to assume a bowed shape when heated, the hotter end of the drum assuming a convex shape and the less hot end a concave shape. Excessive clearances of threequarters of an inch have been known as well as a complete lack of clearance in which there is an unintentional clashing of the metal seal plates with the adjacent sealing surfaces. These problems are further aggravated by the hostile environment to which an air preheater is subjected. The dirty, soot and acid-laden discharge gas which passes through the air preheater results in soot buildup, corrosion, and wear, all of which contribute to irregularities in the relatively movable parts. The irregularities, of course, lead to sealing difficulties.

Attempts to maintain a constant clearance between the sector plates and adjacent radial seals have only been partially successful. For example, U.S. Pat. No. 4,124,063 discloses sector plates which are deflected at their outer ends by a mechanical actuator. This mechanical actuator is responsive to axial movements of the axle. Accordingly, as the axle is thermally deformed, the sector plate is forced into a dish configuration to minimize leakage between it and the deformed radial seals. However, the mechanical actuator will eventually break down as a result of the intense conditions discussed above, causing the sector plate to contact the radial seals and leading to a shut-down of the air preheater for time consuming repair. More significantly, this deflection of the sector plate ends results in a clearance which does not conform to the spherical deformation experienced in the radial seals as they are heated. Accordingly, leakage occurs between the sector plates and the radial seals.

Another currently used sealing system is shown in U.S. Pat. No. 4,122,891 and uses a hinged sector plate. Each hinged portion is independently actuated in response to the thermal expansion of the axle. In addition to the longevity and maintenance problems discussed above, this system does not result in optimum leakage control since the sector plate portions at best can only maintain a tangential relationship with the spherically deformed radial seals, resulting in leakage.

Another sealing system is shown in U.S. Pat. No. 4,024,907. This system uses a screw jack to deform the outer portion of the sector plate in an attempt to conform to the spherical deformation of the radial seals. However, such deformation results in the sector plate being tangential to the spherically curved radial seals, resulting in leakage between the two halves of the drum.

In presently known air preheaters, particularly those of the Ljungstrom type, additional sealing problems are encountered at the circumference of the drum where the radial seals end. Such sealing problems are also encountered adjacent the drum axle, near where the radial seals begin. At present, it is typical to provide post seals adjacent the drum axle and circumferential seals adjacent the drum periphery. The radial seals then extend between the post and circumferential seals. Such a sealing arrangement, however, creates gaps between the different types of seals, which gaps contribute to an undesirable amount of leakage along paths which bypass the heat exchanging drum of the air preheater Heretofore, it has not been known how to eliminate these gaps in a Ljungstrom type air preheater.

It is an object of the present invention to maintain a constant clearance between the radial seals and the sector plates of an air preheater throughout the wide range of operating temperatures of air preheaters.

It is a further object of the present invention to maintain such a constant clearance simply without the use of complicated actuators.

It is yet another object of the present invention to provide a continuous: perimeter seal for an air preheater, i.e., it is an object of the invention to seal an air preheater such that there are no discontinuities in the seal perimeter.

More specifically, it is an object of the present invention to improve the total sealing package for an air preheater by providing unbroken seals completely around the paths through which flue gases flow from the furnace and intake air flows toward the furnace, such unbroken seals being located in the areas between the drum and housing.

It is a further object of the present invention to provide an air preheater in which such continuous, unbroken seals take the form of flexible expansion joints.

It is a related object of the present invention to replace the presently known arrangement of post seals, radial seals and circumferential seals, which known seals result in gaps which create leak paths, with gapless flow paths for the intake air and the flue gases.

It is a further object of the present invention to provide such gapless flow paths in a Ljungstrom type air preheater.

Other objects and advantages of the present invention will become apparent in the specification and drawings which follow.

SUMMARY OF THE INVENTION

The foregoing and additional objects are obtained by a sealing structure for an air heater according to the present invention. The sealing structure comprises deformable sector plates which divide a housing for the air heater into an air intake half and a gas discharge half. The sector plates are located at both ends of a drum which contains the heat exchange elements. A gap is formed between the drum and the sector plates to allow relative rotation between the drum and sector plates.

Deflection governing struts or beams are coupled with the sector plates and extend across the sector plates. The struts or beams are bendable in response to thermal deflections of the drum to cause the sector plates to bend into shapes corresponding with the thermal deflections of the drum.

Outer rings are coupled with radially outward ends of the struts or beams, and these rings cooperate with guides which are affixed to the drum and engage the rings. Thus, the struts are deformed into curvatures which correspond to an approximate partially spherical curvature of the drum caused by thermal deflections during heating of the air heater. The deformable sector plates are likewise deformed under the influence of the struts or beams in an approximate partially spherical curvature to constantly maintain the gap between the drum and sector plates during temperature changes of the air heater.

Thus, it will be seen that the present invention relates to effecting a seal between a drum and a set of deformable sector plates of an air heater. The invention involves forcing the ends of deflection governing struts or beams to follow the movements of the peripheral edges of the drum relative to the center of the drum. This is accomplished by coupling the strut or beam to the drum in a way which permits relative rotary movement between the strut and drum but does not permit axial movement therebetween.

As indicated, each strut or beam is bent into a shape corresponding with the shape assumed by an adjoining end of the drum due to thermal deflections of the drum as it undergoes temperature changes and is subjected to thermal differentials between one axial end and the other. This bending of the strut and beam occurs as a result of and concurrently with the foregoing forcing of the ends of the strut or beam to follow the movement of the peripheral edges of the drum.

The present invention also entails moving the deformable sector plates and forming them into a shape corresponding to the shape assumed by the adjoining end of the drum due to thermal deflections and differentials. This moving of the deformable sector plates is carried out as a result of coupling of the deformable sector plates to the struts or beams and as a result of constraining the deformable sector plates to deform into a shape dictated by the bending of the struts or beams.

With these steps, a substantially constant clearance is maintained between the drum and sector plates by ensuring that the deformation of the sector plates follows the thermal deformations of the drum. In this regard, the ends of the drum, as indicated, move between flat configurations, when cold, to approximately partial spherical shapes when hot. This, in turn, entails displacing regions of each strut or beam adjacent the ends thereof more than regions of the same strut or beam adjacent its center.

The present invention also provides for a continuous perimeter seal for the air preheater, i.e., a seal in which there are no discontinuities in the seal perimeter. In this way, the total sealing package for the air preheater is improved by providing a set of unbroken seals completely around certain parts of the paths through which flue gases from the furnace flow through the air preheater and through which intake air flows toward the furnace through the air preheater. The parts of the paths having the unbroken seals have, in previously known arrangements, had gaps between various seal components. The continuous, unbroken seals of the present invention preferably take the form of flexible expansion joints to create the gapless flow paths through parts of the air preheater.

The set of expansion joints creating the gapless flow paths are shaped to surround the flow paths in the regions between the housing and drum. Each expansion joint provides a complete seal adjacent the drum axle, preferably by extending between the housing and a central thrust ring or bearing. Previously, post seals had been used, and such post seals were discontinuous with respect to the radial seals, thus creating gaps and leak paths. The expansion joints also provide complete seals at the outer circumference of the drum. Preferably, each expansion joint extends between the housing and a circumferential ring which cooperates with the drum circumference to effect a complete circumferential seal. In the area between the center of the drum and its circumference, each expansion joint preferably extends between the housing and the set of sector plates which delimit the particular flow path being sealed. Thus, at the one axial end of each continuous hollow expansion joint which is adjacent the drum (i.e., the inner end which is opposite to the end which attaches to the housing), the part of each expansion joint contributing to a radial seal will surround the area from one sector plate to the other sector plate. That is, such inner end of the expansion joint will extend outwardly along a first sector plate, thence around the circumference of the drum by attachment to the circumferential ring, thence inwardly along a second sector plate to the drum axle, and thence around the drum axle by attachment to the center ring to complete the circuit back to the first sector plate. As indicated, this circuit is completed with a continuous, fabric-like, flexible material to provide the essentially gapless flow paths of the present invention. In this regard, the only gaps which remain are those controlled gaps to which the invention is also directed.

It will be understood that the foregoing discussion as to the components to which parts of the expansion joints will be attached contemplates attachments to functional equivalents of the specific components mentioned. For example, rather than being attached to the sector plates themselves, the edges of the inner ends of the expansion joints may be attached to the struts or beams which govern the deformation of the sector plates. Indeed, this is the preferred embodiment. Also, at the opposite axial end of each hollow expansion joint, the edges may be attached to the associated flue gas duct or air duct rather than to the housing of the air preheater.

DETAILED DESCRIPTION OF THE PREFERRED EMBODIMENTS

FIGS. 1–6 depict a conventional fuel burning arrangement with an air preheater to bring the background and environment of the present invention. It will be understood that this depiction and discussion of the environment of the invention is for illustrative purposes and that the invention may be used in other environments, for example, the invention may be used in other types of coal-fired combustion systems, as well as in systems with gas and oil-fired boilers.

Figure 1:
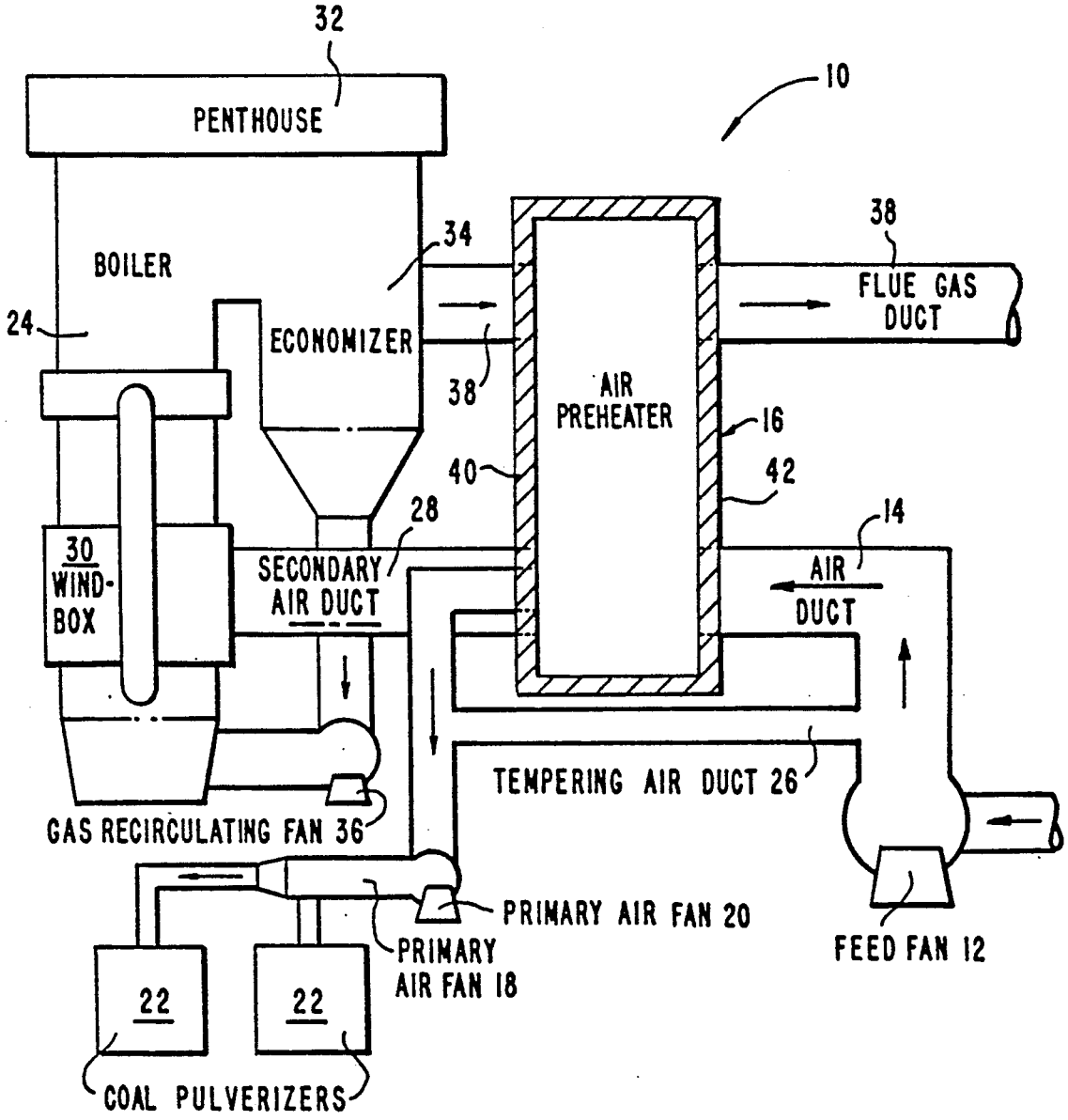
FIG. 1. (PRIOR ART)
FIG. 1 is a schematic illustration of a fuel burning facility showing the environment for the air preheater of the type to which the present invention is directed.

FIG. 1 depicts a fuel burning facility generally referred to by reference numeral 10. Fuel burning facility 10, as shown in FIG. 1, is of a type typically used in power plants for burning pulverized coal to produce steam which, in turn, will drive turbines to produce electricity. Intake air is fed into fuel burning facility 10 by a fan 12 via intake air duct or passage 14. This intake air is fed into one side of a conventional air preheater generally referred to by reference character 16. Air preheater 16 utilizes discharge flue gases to preheat the intake air flowing through duct 14. This preheating increases the efficiency of the fuel burning operation.

Downstream of the air preheater 16, primary air for entraining pulverized coal is tapped off from air duct 14 both downstream of the air preheater and also via a tempering air duct 26 which bypasses the air preheater. Primary air passes through primary air duct 18, and its flow is boosted by a primary air fan 20 which feeds the primary air to coal pulverizers 22. The primary air entrains the pulverized coal and feeds it to the boiler 24.

Meanwhile, the remaining air which passes through the air preheater 16 continues on through the secondary air duct or passage 28 and then into the wind box 30. This is secondary air and is the air which supports combustion. The secondary air is fed to the boiler along with the pulverized coal entrained in primary air.

Above the boiler 24 is a penthouse 32, and downstream of the boiler is an economizer 34 which effects recirculation of gases via gas recirculation fan 36. The remainder of the flue gases are discharged via flue gas duct or passage 38 which passes through another side of the air preheater 16 for preheating the cold intake air flowing in through air duct 14.

It will be noted that, as seen in FIG. 1, one-half of the right-hand end of the air preheater receives cold intake air and another half of the right-hand end discharges flue gases from which heat has been extracted. That is, the flue gas being discharged is cooled flue gas. Since both the air flowing into and the gas flowing out of the right-hand end of air preheater 16 (as viewed in FIG. 1) is relatively cool, that end is referred to as the cold end 42. By the same token, intake air flowing out of the left-hand end of the air preheater (as viewed in FIG. 1) will be relatively hot, as will the flue gases flowing into the left-hand end of the air preheater (as viewed in FIG. 1). Accordingly, the left-hand end (as viewed in FIG. 1) is referred to as the hot end 40.

Figure 2:
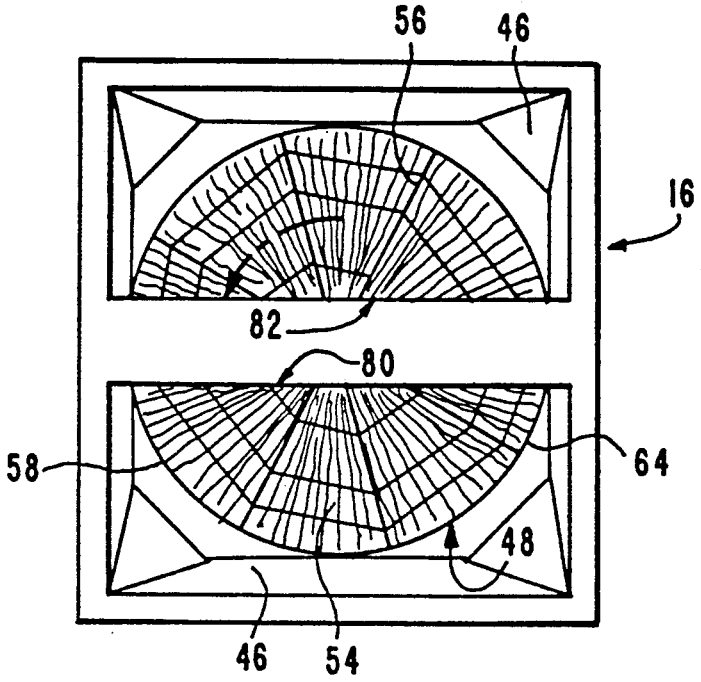
FIG. 2. (PRIOR ART)
FIG. 2 is a plan view of such an air preheater.

Referring now to FIG. 2, the main portions of conventional air preheater 16 include a housing 46 and a cylindrical drum 48 in the housing. Housing 46 surrounds drum 48. Housing 46 and drum 48 are rotatable relative to each other about a rotor post or drive axle 49. In the specific embodiment of the air preheater shown and described herein, housing 46 is stationary and drum 48 rotates within the housing. Another type of air preheater is known, however, in which just the opposite is the case. Specifically, the drum is stationary and the housing rotates with respect to the drum. This latter type of air preheater is known as a stationary matrix air preheater. The present invention, as illustrated, described and claimed herein, is equally applicable to both an air preheater having a rotating drum, as specifically disclosed, as well as to a stationary matrix air preheater.

Figure 3:
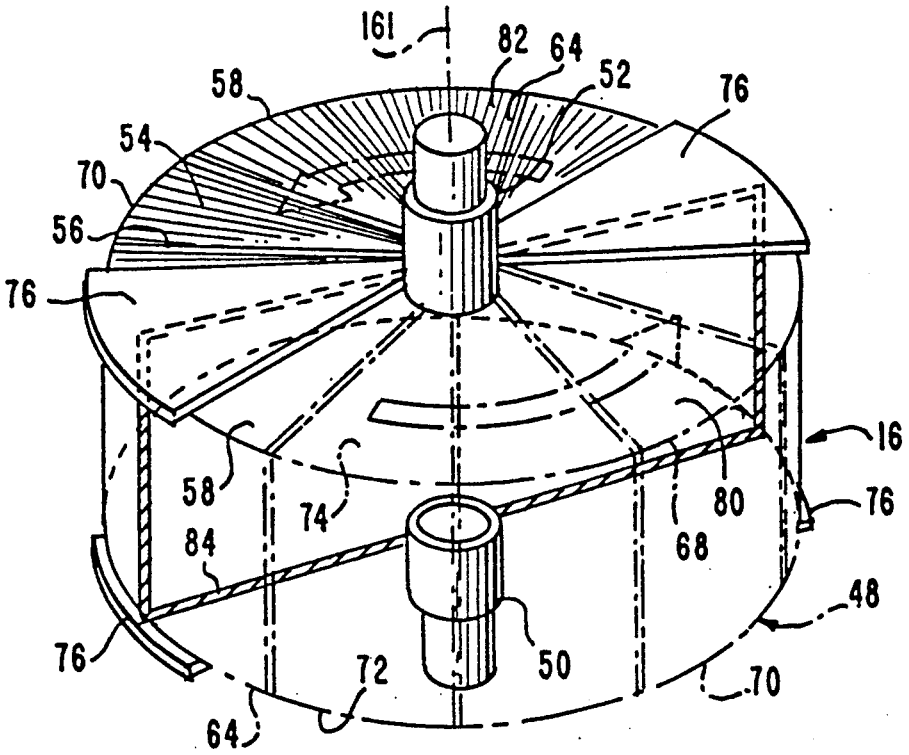
FIG. 3. (PRIOR ART)
FIG. 3 is a schematic isometric view of the drum of the air preheater also stowing the sector plates of the housing.

Drive axle 49 of the conventional air preheater 16 (FIG. 5) is journaled in a lower bearing assembly 50 and an upper trunnion and bearing assembly 52 sealed by a rotor post seal 53 (FIG. 3). Drum 48 includes sets of heat exchanging elements 54 therein which define a heat exchange matrix. Heat exchanging elements 54 take the form of metallic heat transfer plates 58 normally having a corrugated configuration and maintained in spaced relation to provide passages therebetween for the flow of gas and air axially of the drum 48. Drum 48 also includes a plurality of radially extending diaphragms 56 which divide drum 48 into sectors 58, each sector containing a set of heat exchanging elements 54. Each diaphragm 56 includes a diaphragm member 60 in the form of a radially extending flat metal plate having radial edges 61 adjacent the cold end 42 thereof.

Further, the cylindrical drum has a pair of oppositely disposed circular ends 64 adjacent both the hot and cold ends 40, 42 of the air preheater, each circular end being defined by a circular edge 70 of the drum. The circular ends and circular edges 64, 70 define a hot end 72 and a cold end 74 of the drum 48 corresponding respectively to the hot end 40 and cold end 42 of the air preheater 16. Of course, the hot end 72 is the end which receives hot discharge flue gases to be subjected to heat extraction. Hot end 72 is also the end which emits intake air which has been preheated. Likewise, the cold end 74 of drum 48 is that end which receives intake air for the fuel burning facility, which intake air is to be preheated. Finally, the cold end 74 of drum 48 is also that end which emits discharge gas from the fuel burning facility, which discharge gas has been subjected to heat extraction and thus cooled.

The housing 46 includes a plurality of sector plates 76, each sector plate having a sealing surface 78 which faces toward the drum 48. Sector plates 76 divide housing 46 into an air intake half 80 and a gas discharge half 82. The plane 84 representing the boundary between these two halves, 80, 82 is shown in FIG. 3. As is particularly apparent from FIG. 3, there is one pair of sector plates disposed adjacent the hot end 72 of drum 48 and another pair of sector plates 76 disposed adjacent the cold end 74 of drum 48. Each sector plate 76 corresponds in configuration to a sector 58 of the drum.

Diaphragms 56 of drum 48 include a set of semi-rigid radial seal plates 86 coupled with diaphragm members 60 to extend lengthwise along diaphragm members 60, specifically, along their radial edges 61, 62 at the hot and cold ends 72, 74 of drum 48. Radial seal plates 86 are rigidly attached to diaphragm members 60 by holding members 88 and secured by fasteners 90.

Figure 5:
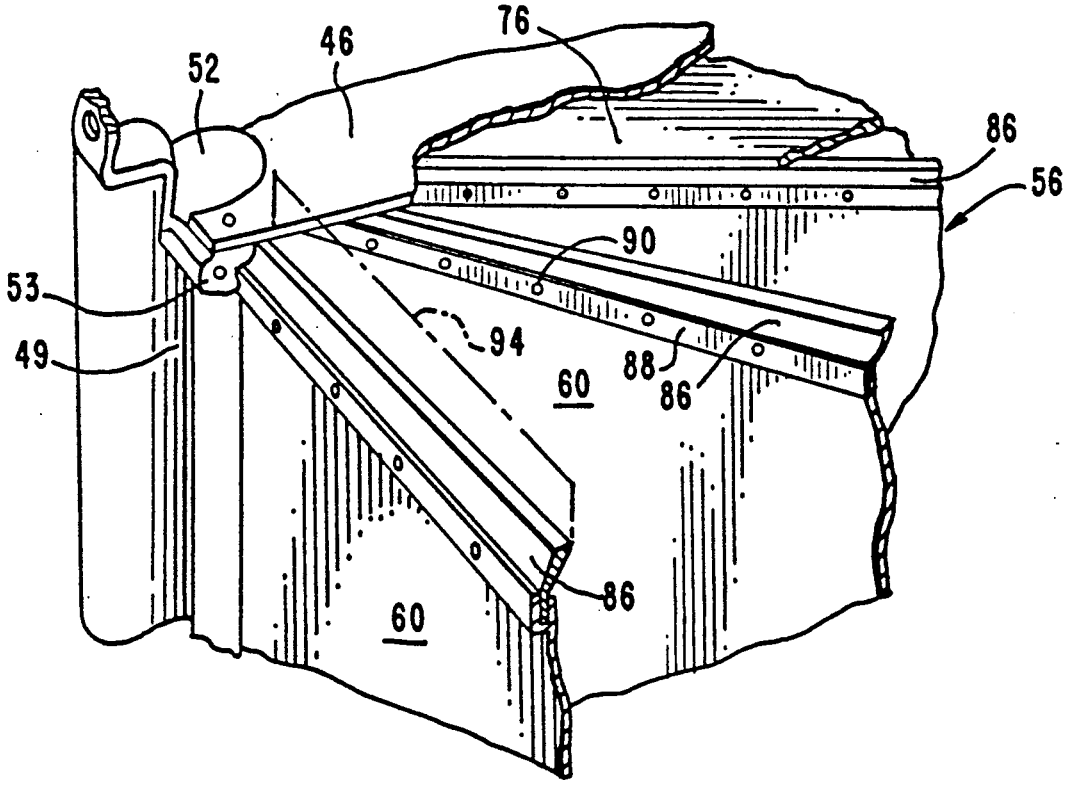
FIG. 5. (PRIOR ART)
FIG. 5 is a fragmentary isometric view showing the sectors of the drum of the air preheater with the known outwardly extending seal plates.

Each radial seal plate 86 has a width 92 (FIG. 6) extending normal to its length 94 (FIG. 5). Aside from their previously described radial extension along the diaphragm members 60, the radial seal plates 86 also extend generally axially from the drum in the direction of their widths, each radial seal plate having an outer radially extending edge 96 most remote from the drum 48. As already alluded to, reference to the radial seal plates 86 extending "axially" from the diaphragm member 60 is not meant to imply that the radial seal plates are necessarily in the same or parallel plane as the directly radially extending diaphragm members 60. Rather, "radially" in this context simply means that there is a significant radial component to the direction of extension of the radial seal plates 86. The radial seal plates 86 are of such rigidity so as not to normally yield during operation of the air preheater 16.

Figure 6:
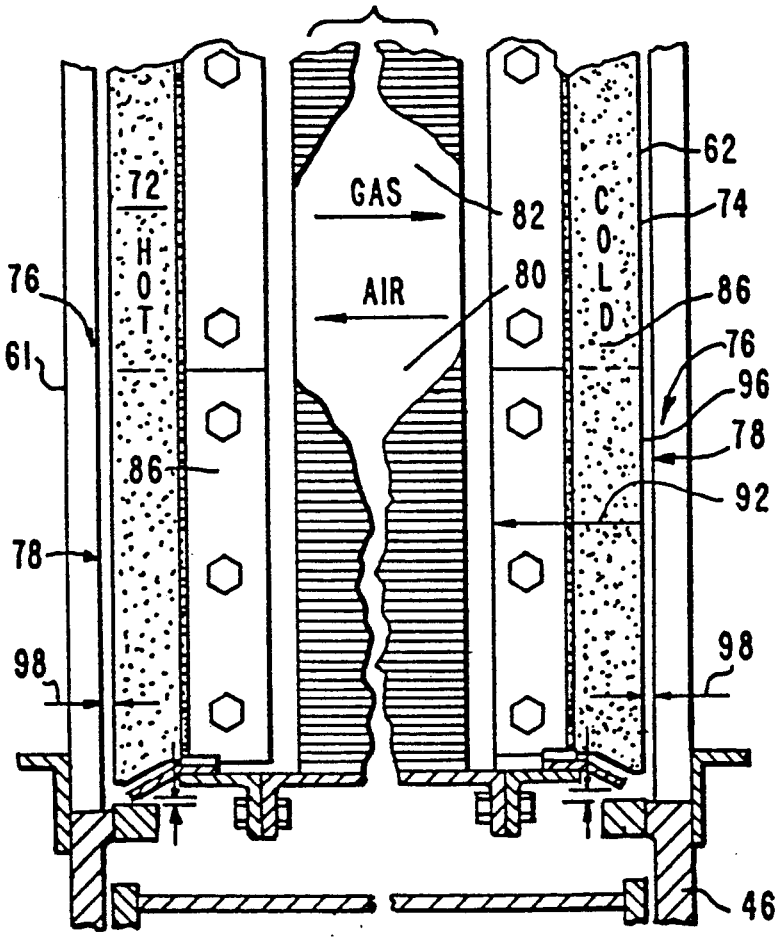
FIG. 6. (PRIOR ART)
FIG. 6 is a fragmentary sectional view through a known air preheater showing both the radial and circumferential seal plates and the associated sealing surfaces of the housing.

During relative movement between the drum and the housing, the outer radially extending edges 96 of the radial seal plates 86 and will normally pass closely by sector plate 76. That is, there is normally a small clearance 98 between the outer radially extending edge 96 of radial seal plate 86 and the sealing surface 78 of conventional sector plate 76 (FIG. 6). In theory, the idea is to maintain a small yet definite clearance 98 to allow relative movement between the sector plates and radial seal plates while reducing mingling of the two fluid paths into and out of the drum 48. In practice, however, this is not an easy matter.

Figure 4:
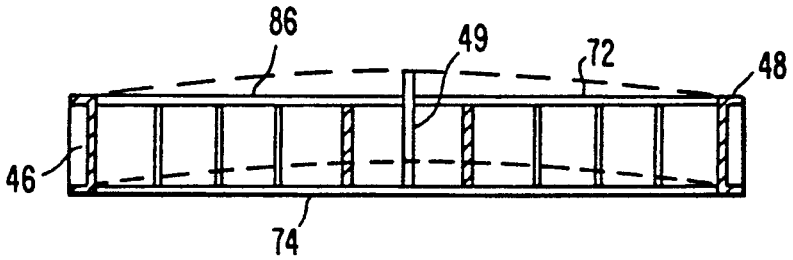
FIG. 4 is a side sectional view of the drum during a relatively cool operating condition, with the deformation during a relatively hot operating condition being shown by dashed lines.

Referring to FIG. 4, increased temperatures cause the drum and its radial seals to deform with a partial, approximately spherical curvature, resulting in a convex surface at hot end 72 and a concave surface at cold end 74, as shown in exaggerated fashion by the phantom lines. Likewise, decreased temperatures cause the drum and radial seals to return to a flat condition as shown in solid lines. Accordingly, the drum and seal plates 86 tend to either clash with conventional sector plates 76 or to be moved an undesirable distance from conventional sector plate 76. Since sector plates 76 are conventionally constructed of a generally stiff, semi-rigid metal plate material, the metal-to-metal contact which will occur upon clashing can be quite disadvantageous and can lead to failures.

An air preheater arrangement which overcomes the drawbacks of conventional systems is illustrated in FIGS. 7–10. There, the air preheater is generally referred to by reference numeral 16'.

Figure 7:
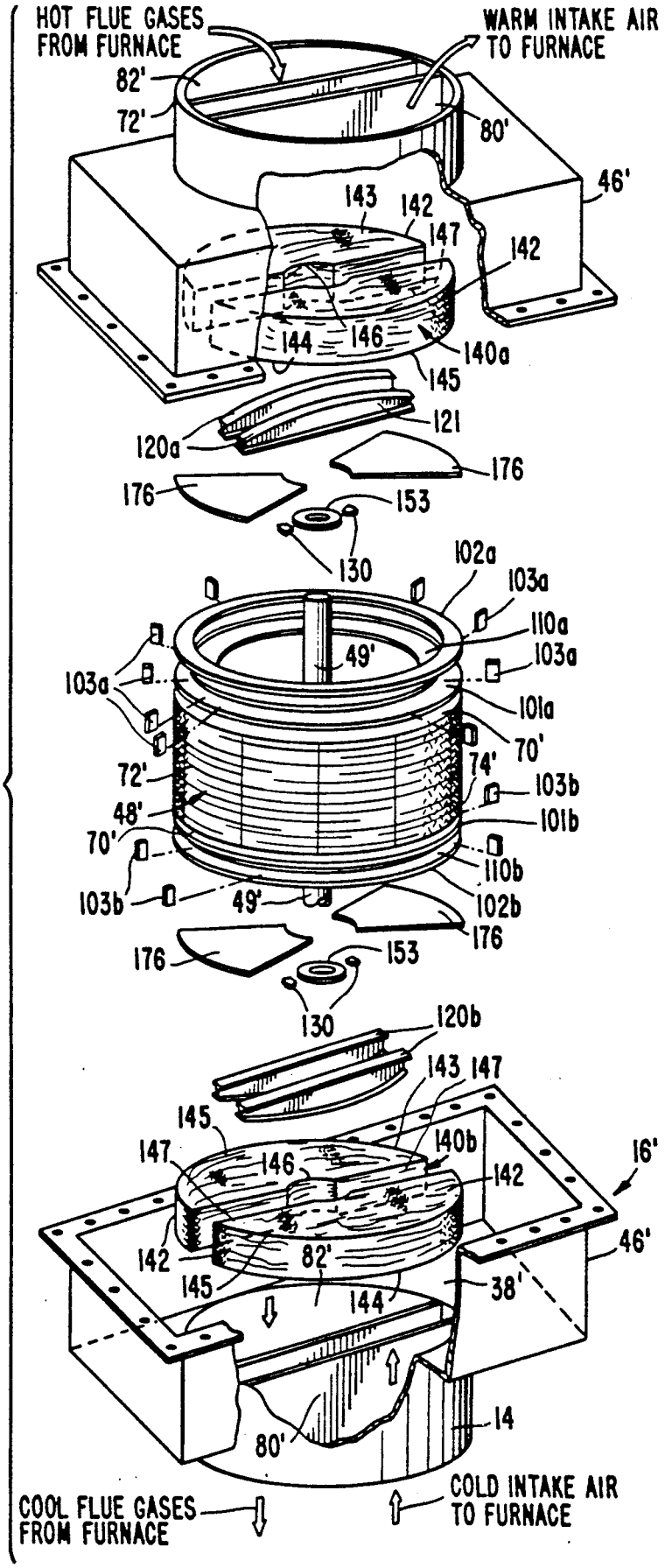
FIG. 7 is an exploded perspective view of a preferred embodiment of the sealing system according to the present invention.
Figure 8:
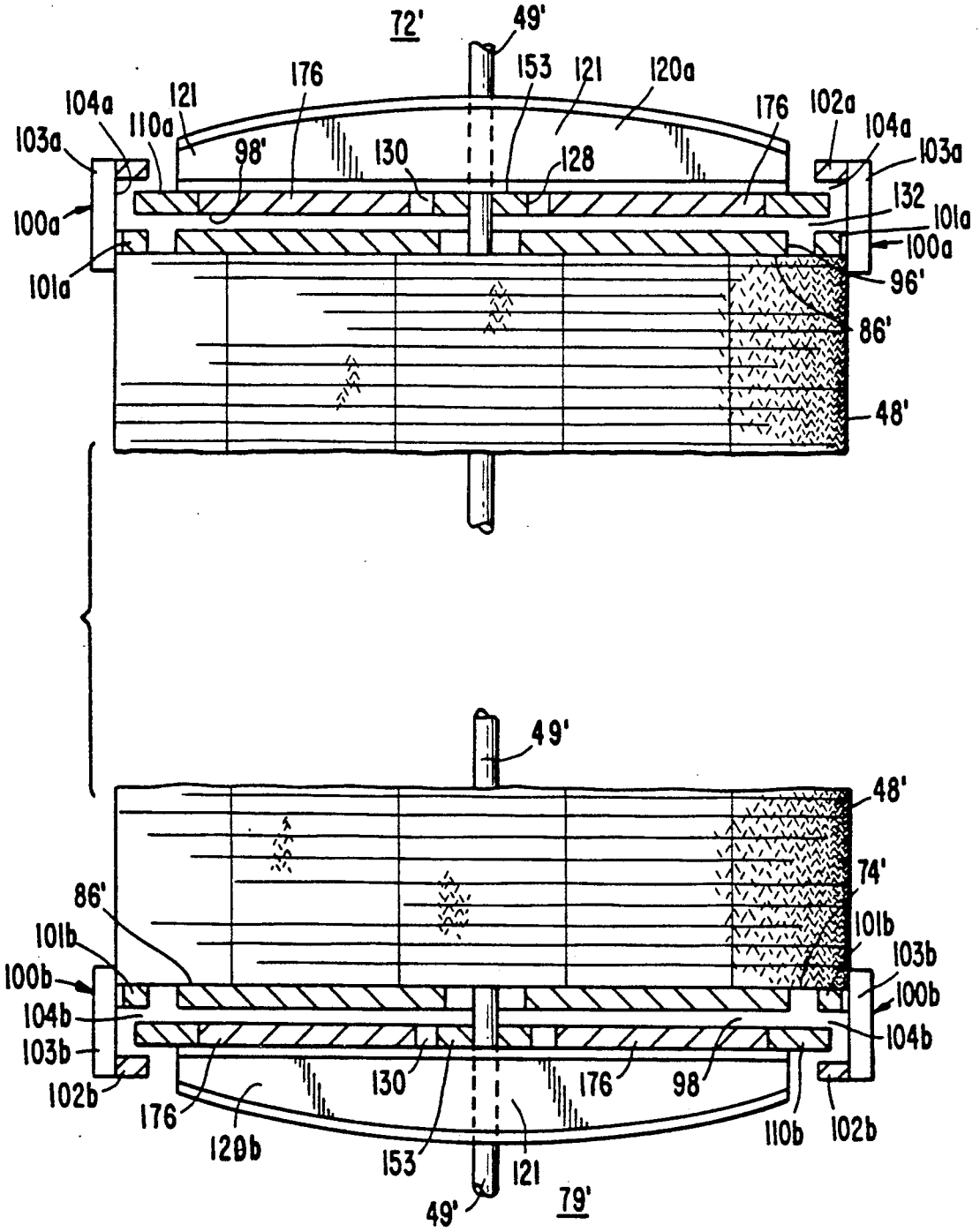
FIG. 8 is a fragmentary side elevational view, partly in section, of certain elements of the preferred embodiment showing the undeformed radial seals and sector plates in a relatively cool operating condition.
Figure 9:
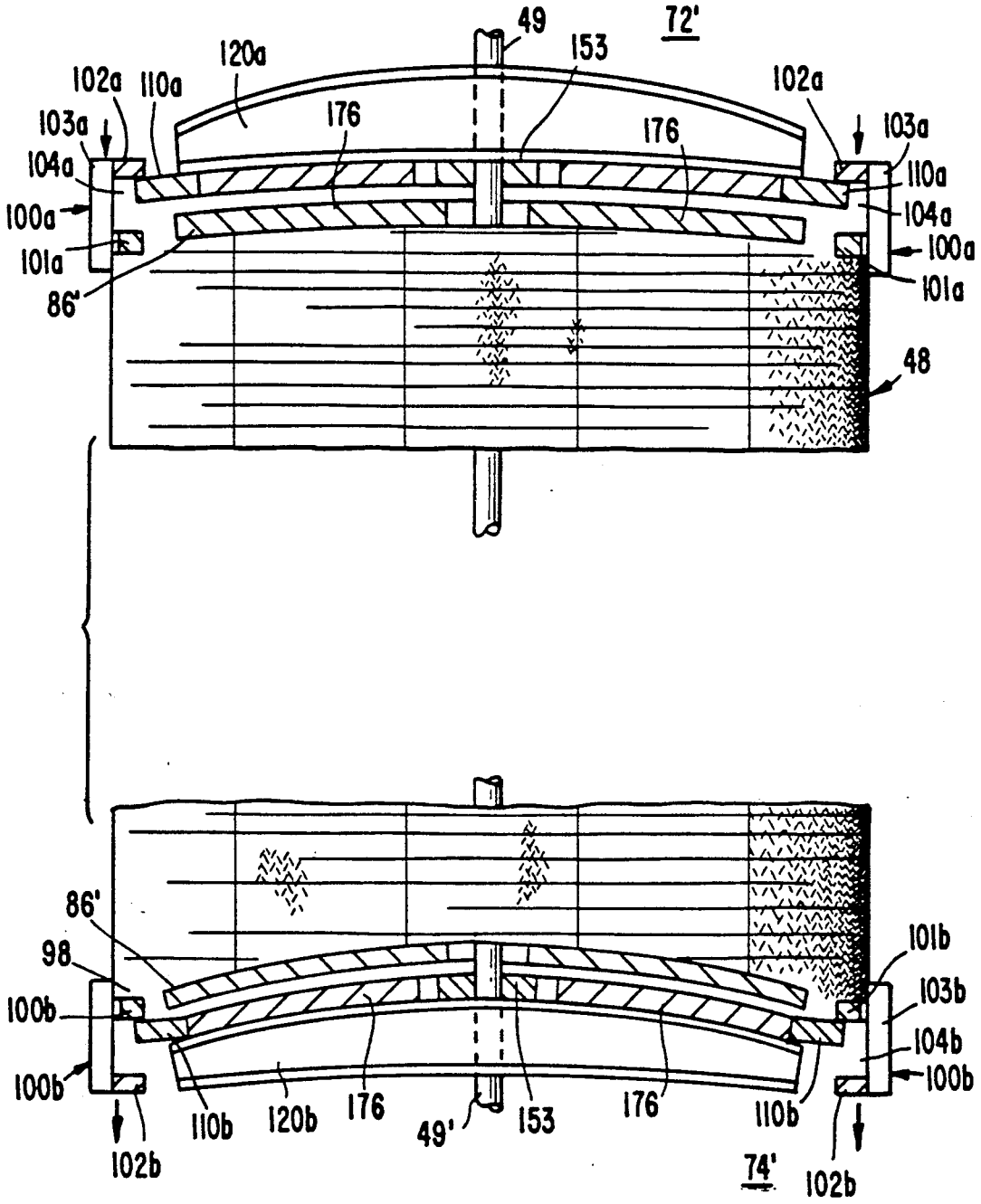
FIG. 9 is a fragmentary side elevational view, partly in section, of the drum showing the deformed radial seals and sector plates of the preferred embodiment in a relatively hot operating condition.

Referring now to FIG. 7, rotating drum 48' with an axle 49' is enclosed by a housing 46' having two halves joined together. Referring to FIGS. 8 and 9, guides **100*a,b* are fixed near the circular edges 70' of drum 48' which correspond respectively to hot end 72' and cold end 74'**.

The upper guide **100*a* includes an inner ring 101*a* fixed to the outer periphery of the upper circular face of drum 48 and sealed with respect thereto. Upper guide 100*a* also includes an outer ring 102*a* which is concentric with inner ring 101*a* and which is axially spaced therefrom a slight distance. Outer ring 102*a* is fixed with respect to drum 48, by a series of ring support brackets 103*a* disposed at spaced locations around the periphery of the upper end of drum 48'. That is, ring support brackets 103*a* are affixed both to drum 48' and outer ring 102*a* to hold outer ring 102*a* in slightly axially spaced disposition with respect to both the drum 48' itself and the inner ring 101*a*. Preferably, inner ring is of a separate piece from outer ring 102*a* and from brackets 103*a* which hold outer ring 102*a* in place. Together, inner ring 101*a*, outer ring 102*a* and brackets 103*a* of upper guide 100*a* form a radially inwardly facing, circumferential, generally C-shaped channel 104*a*. Of course, the circumferential channel 104*a* will not be C-shaped at every cross section along an axial plane through the upper guide 100*a*, since the brackets 103*a*** forming the connecting leg of the "C" are used only at selected, spaced locations around the periphery of the drum.

The construction of lower guide **100*b* is analogous to that of upper guide 100*a* and will be described more briefly. Lower guide 100*b* includes an inner ring 101*b* fixed to the outer periphery of the lower circular face of drum 48' and sealed with respect thereto. An outer ring 102*b* is fixed with respect to drum 48' by a series of lower ring support brackets 103*b* to form a radially inwardly facing, circumferential, generally C-shaped channel 104*b***.

In FIG. 7, the various components of guides **100*a,b* are shown in exploded form. In FIGS. 8 and 9**, on the other hand, these components are shown in assembled form.

C-shaped circumferential channels **104*a,b* are sealed to the matrix conduit, e.g., the drum 48' in this instance. C-shaped channels 104*a,b* each engage a corresponding one cf continuous circumferential rings or guide rings 110*a,b* which are concentric with drum 48' and are located adjacent the edges 70' of drum 48'. Each circumferential ring 110 is fixed with respect to sector plates 176 and housing 46' so that the surrounding circumferential C-shaped channel 104 moves relative to circumferential ring 110 in close proximity and in registry therewith. Circumferential rings 110***a* act as radial extensions of the sector plate rims. Preferably, the bearing surfaces, i.e. the surfaces which face into the channel, of C-shaped channel 104 are composed of a hard material which results in low wear and therefore a longer life. One such material is stellite, a cobalt alloy containing chromium and tungsten. A similar bearing surface exists near the drum axis.

Figure 10:
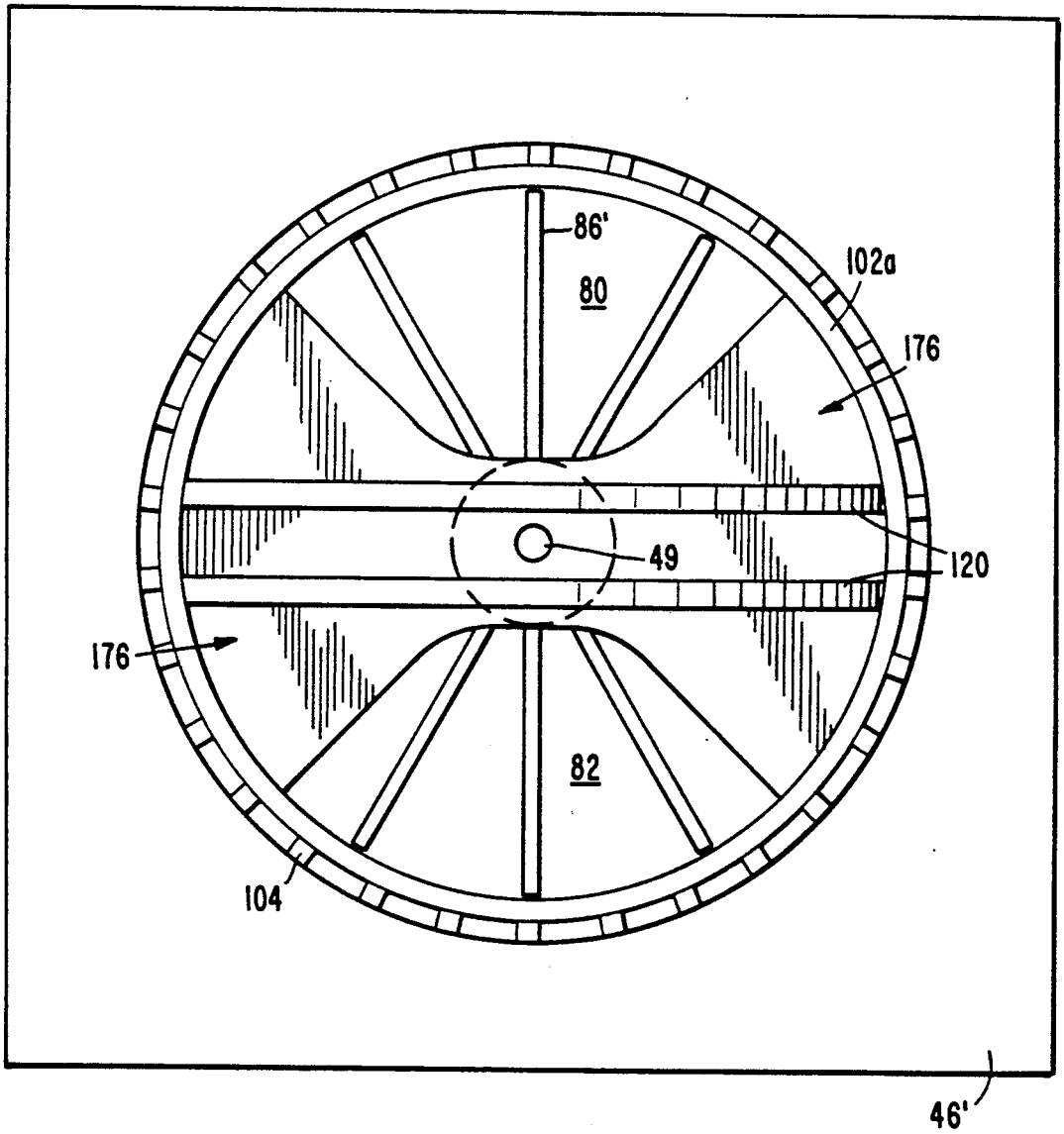
FIG. 10 is a plan view of the housing and drum similar to that of FIGS. 7–9, but in which the sector plates at each end are integrally joined together at the center to assume a bow tie shape.

Sector plates 176 divide the housing 46 into an air intake half 80' and a gas discharge half 82'. Unlike conventional sector plates comprised of rigid steel, sector plates 176 are comprised of relatively thin sections of metal, preferably a corrosion resistant alloy, to provide minimum resistance to deflection, as described more fully below. Sector plates 176 may be composed of two plates radially opposed to one another with the axle 49' passing between them. Alternatively, a single plate with the axle passing through the center may be utilized, as shown in FIG. 10. This latter structure may be formed in a bow-tie shape, as illustrated.

In operation, air preheater 16' is subjected to a wide range of temperature variations. Referring to FIG. 8, a relatively cool condition is shown wherein sector plate 176 at hot end 72' is perpendicular to axle 49'. Also, radial seal plates 86' are parallel with the sector plates 176 such that a substantially constant clearance 98' is formed between sector plate 176 and the edge 96' of radial seal plate 86'. Likewise, the sector plate 176 located at cold end 74' is perpendicular to axle 49' and has a constant clearance 98' between it and radial seal plates 86'.

Referring now to FIG. 9, a relatively hot operating condition of air preheater 16' is shown. In this condition, the ends of drum 48' and their radial seals 86' are deformed into a approximate partial spherical curvatures. One spherical curvature is convex at hot end 72', and the other is concave at cold end 74'. Thus, clearance 98' will be altered, which would, if not compensated for, greatly increase the leakage between the air intake half and gas discharge half and which would also increase the likelihood of undesirable contact between the sector plates and the radial seals on the gas inlet and air discharge halves.

To maintain a desirable clearance, the present invention accommodates deformation of the radial seals and drum ends through deformation and dislocation of the sector plates and synchronizes this deformation of the sector plates with the deformation of the radial seals and drum ends. The deformation of the sector plate may be accomplished by causing a relative movement between the circumference or outer portion of the sector plate and the inner portion of the sector plate.

Each sector plate 176 has two deflection governing struts or beams 120 which extend radially across the outwardly facing side of sector plate 176. One pair of beams is referred to by reference numeral 120*a*, the other pair by reference numeral 120*b*. Beams 120 are more rigid than the deformable section plates 176. Each pair of beams 120 are parallel to one another and pass on opposite sides of axle 49. The structure and location of beams 120*a,b* are discussed more fully below.

The ends of beams 120*a* and 120*b* are fixed, respectively, to circumferential rings 110*a*, 110*b*. Thus, beams 120*a,b* and circumferential rings 110*a,b* are stationary relative to rotating drum 48' and guides 100*a,b* in the case where drum 48' rotates relative to housing 46', as in the preferred embodiment disclosed herein. Conversely, beams 120*a,b* and rings 110*a,b* would rotate relative to stationary drum 48, and guides 100*a,b* in the case where the housing or hood rotates relative to the drum. To ensure smooth relative movement between ring 110*a,b* and guides 100*a,b*, the ends of beams 120*a,b* should be fixed to the inner diameter of rings 110*a,b* to avoid any interference with guides 100*a,b*.

Thrust bearings or central thrust rings 153 are located on axle 49' and are connected to sector plates 176 and beams 120*a,b* via sector plate extensions 130. Sector plate extensions 130 are connected to radially inward ends of the sector plate if two plates are used, or are connected to the central portion of the sector plate structure if a single plate is used.

Referring now to FIG. 8, beams 120*a* are located at hot end 72' and beams 120*b* are located at cold end 74'. The inner surfaces of beams 120*a* and 120*b*, i.e., the surfaces facing radial seals 86, contact the sector plates 176 at the respective hot and cold ends. These inner surfaces of beams 120*a* and 120*b* are perpendicular to axle 49' in the relatively cool operating condition discussed above. In this cool operating condition of air preheater 16', the ends of drum 48' and their radial seals 86' are not spherically deformed. In this state, radial seals 86', sector plates 176 and the inner surfaces of beams 120*a* and 120*b* are substantially parallel.

Referring now to FIG. 9, a relatively hot operating condition of air preheater 16' is shown wherein radial seals 86' assume a partially spherical curvature which is convex at hot end 72' and concave at cold end 74', as shown in exaggerated form for illustrative purposes.

When this convex deformation occurs at hot end 72', guides 100*a* move axially toward the opposite end of drum 46' because outer edge 70' of drum 46' moves in that direction and because guides 100*a* are affixed to drum 46' adjacent outer edge 70'. Accordingly, engaged circumferential ring 110*a* moves in this same direction, causing deformation of the beams 120*a* such that the ends of beams 120*a* move axially in the same direction. Based on this axial force and on a center reaction provided by one of the thrust bearings 153, the beam 120*a* bends to assume a convexly curved shape, and in particular a shape which corresponds with that of the radial seals and drum end. This curving bend of each beam 120*a* is approximately spherical to correspond to the spherical deformation of the end of drum 40' and its radial seal plates 86'.

It will be understood that the bending of each beam 120*a* is the result of forces applied at essentially three points, as is the classic case for creating a bending moment. Two of the three points are the points at the radially outer ends of beams 120*a*, where forces are transmitted from the downwardly turning outer edge 70 of drum 48 through attached guide 100*a* and thence to circumferential ring 110*a* which rides within circumferential C-shaped channel 104*a* of guide 100*a*. These forces are then transmitted from circumferential ring 110*a* to the outer ends of beams 120*a*, to bend the ends of beams 120*a* axially downwardly in the particular arrangement shown in FIGS. 7–9. A central reactive force on beams 120*a* is provided by thrust bearing 153 and by extensions 130 so that the centers of beams 120*a* do not move axially downwardly along with the beam ends. This central reaction results in bending of beams 153 into curved conditions which, in turn, cause associated sector plates 176 to be bent into partially spherical shapes.

To maintain such an approximate spherical curvature, beams 120*a* are formed to have a moment of inertia which decreases linearly from a central bearing point at bearing 153 to an outer end bearing point at guides 100. Since the radius of curvature is defined by the product of the Young's modulus and moment of inertia divided by the impressed moment, the radius of curvature remains relatively constant at all radial distances from the drum axis throughout the operating conditions of the air preheater.

To form beams having such moments of inertia, the outer surface of beams 120*a*, i.e., the surface farthest from the interior of drum 48, is curved convexly. Beams 120*a* will preferably take the form of I-beams which taper from the central bearing point to the edge bearing points. That is, the web portion 121 of each I-beam shape, which web portion has a height extending in the direction of the axis of the air preheater 16, will diminish in height from the center of the beam toward its ends. This allows each beam to bend more easily at its ends, which in turn allows the beams, and thus the sector plates 176, to bend in a manner which corresponds with the deformation of the drum 48' caused by temperature changes and differentials.

That is, as the beams 120*a* assume a convex spherical curvature, the adjacent deformable sector plate 176 also assumes a convex spherical curvature which corresponds to the thermally induced convex spherical curvature of the end of towards the drum 48' and radial seals 86' at hot end 72'. As the outer ends of beams 120*a* move towards the opposite end of the drum 48', the outer ends of the sector plate 176 will also move towards the opposite end of the drum. The deformation of sector plate 176 will be controlled by the deformation of the more rigid beams 120*a*, which is approximately partially spherical for the reasons discussed above. This sector plate deformation conforms with the radial seal deformation.

Accordingly, clearance 98' is maintained substantially constant as air preheater 16' operates, allowing clearance 98' to i.e. determined primarily by the clearance needed to permit relative movement between sector plates 176 and radial seals 86'. Thus, the present invention permits optimal sealing between the sector plates and radial seals.

Clearance 98' is maintained in a similar manner at cold end 74'. Beams 120*b* have a linearly decreasing moment of inertia from the central bearing point to the edge bearing point. To accomplish this, beams 120*b* are thicker at the center than at the outer ends and may either curve or taper in a straight line from the relatively thick center to the relatively thin ends to provide a gradual transition between the relatively thick and thin regions. Again, the same tapering I-beam structure as employed in beams 120*a* is preferably employed in beams 120*b* as well.

At the cold end, the drum 48' and its radial seal plates are deformed into a spherically concave shape. Thus, guides 100*b* are moved axially away from the cold end of drum 48' i.e. in the downward direction as viewed in FIG. 9. Accordingly, engaged ring 110 moves in this same direction, causing the ends of beams 120*b* to deform axially downward into a concave shape in response to the moment induced by thrust bearing 153. The concave shape of beams 120*b* is approximately spherical during various temperature conditions for the reasons discussed previously with reference to the convex shape of beams 120*a*.

As beams 120*b* assume this concave curvature, deformable sector plate 176 also assumes a concave curvature which corresponds to the thermally induced concave partially spherical curvature of the cold end of drum 48' and its radial seal plates 86'. Accordingly, clearance 98 is maintained substantially constant as air preheater 16' operates, permitting optimal sealing between the sector plates and radial seals.

Beams 120*a* and 120*b* may be integral with sector plate structure 176 to maintain an approximately constant spherical curvature during operation of air preheater 16'.

Misalignments between the sector plates and radial seals can occur during installation. To prevent such misalignment from affecting the maintenance of a constant clearance, the radial seals may be equipped with flexible sealing strips (not shown) such as those disclosed in U.S. Pat. No. 4,673,026, which is hereby incorporated herein by reference.

Referring once again to FIG. 7, a hot end expansion joint 140*a* is shown which provides a seal between the warm intake air exiting the air preheater 16' and the hot discharge gases exiting air preheater 16'. Specifically, at hot end 72' the expansion joint 140*a* provides a seal between hot discharge gases from the furnace entering air preheater 16 via conduit 38 and preheated intake air exiting preheater 16' via conduit 14. Similarly, at cold end 74' the cold end expansion joint 140*b* provides a seal between relatively cool intake air entering air preheater 16' via conduit 14' and cooled discharge gases exiting preheater 16' via conduit 38'.

Each expansion joint 140 comprises two joint portions 142 which correspond respectively to the ends of conduits 14 and 38 connected into housing 46'. It will be readily apparent that the length of each strut will correspond generally with the diameter of a pair of oppositely disposed sector plates, which sector plates are well known in the art, as seen from FIGS. 3, 5 and 8. Similarly, the sizes of the expansion joints will correspond generally with the sizes of the inlets and outlets to the air preheater, which inlets and outlets are also well known in the art. (See eg., FIGS. 3 and 7) These portions 142 each have a hollow interior to allow passage of the respective air and gases. One end 143 of each joint portion 142 is sealingly connected with respect to a conduit, although the actual connection is preferably to the housing 46' rather than the conduit itself. At the other end 144 of joint portion 142, a continuous perimeter seal is formed by attachment of a peripheral joint edge 145 to outer ring 110 while an inner edge 146 is sealingly connected to thrust bearing 153 and an intermediate edge 147 is connected to one of the beams 120. Of course, rather than being connected to beams 120, the intermediate edge may be connected to the sector plates 176 themselves. Joint portions 142 are composed of a flexible material, preferably a fabric material, to allow for relative movement between the conduits and the heat exchange matrix located within drum 48. Other types of expansion joints, however, may be used. Accordingly, expansion joints 140*a,b* provide seals between the heat exchange matrix and the conduits or ducts 14 and 38 to reduce mingling of the intake air and discharge gases.

Although the invention has been described with reference to preferred embodiments, it will be understood that modifications and changes can be made without departing from the scope and spirit of the invention.

What is claimed is:

1. A sealing structure for an air heater, the air heater effecting a heat exchange between discharge gas from a fuel burning device and intake air to the fuel burning device, the air-heater comprising:

a housing;

a generally cylindrical heat exchange matrix in the form of a drum surrounded by the housing, said housing and drum being relatively rotatable, one with respect to the other;

a hot end of the drum defined by the introduction of the discharge gas and the exit of the air intake;

a cold end of the drum defined by the exit of the discharge gas and the introduction of the intake air;

heat exchange elements located within the drum, wherein said hot and cold ends of said drum each undergo a change of shape in response to a change of temperature in said drum, the sealing structure comprising:

deformable sector plates which divide the housing into an air intake half and a gas discharge half, said sector plates being located at the hot and cold ends of the drum, said sector plates being coupled with the drum, wherein gaps are formed between the drum and sector plates and wherein said sector plates bend when said drum changes shape as it undergoes temperature changes, at least one deflection governing strut extending radially across each of said sector plates, each strut being more easily bendable near its ends than near its center so as to govern bending of an adjacent sector plate to correspond with the change of shape by the drum as it undergoes temperature changes;

whereby each deflection governing strut induces an approximate partially spherical curvature to the sector plates, which curvature conforms to an approximate partially spherical curvature of the drum resulting from thermal deformation of the air heater when it becomes hot, whereby said deformable sector plates are likewise influenced by said deflection governing struts to assume an approximate partially spherical curvature to constantly maintain the gap regardless of the air heater temperature.

2. The sealing structure according to claim 1 further comprising:

circumferential rings corresponding to the hot and cold ends of the drum, respectively, and connected to distal ends of said struts; and guides fixed to the drum for engaging said rings.

3. The sealing structure according to claim 1 wherein said struts have moments of inertia which decrease in a radially cutward direction from the centers of the struts.

4. The sealing structure according to claim 2 further comprising flexible, hollow expansion joints sealingly connected at one end with respect to each duct, respectively, and connected at another end to said deflectors and said outer ring.

5. The sealing structure according to claim 1 further comprising a drive axle coupled with said drum and a bearing located about the axle and engaging each strut adjacent its center.

6. The sealing structure of claim 2 wherein said guides have circumferential C-shaped channels which engage said outer rings.

7. A sealing structure for an air heater, the air heater effecting a heat exchange between discharge gas from a fuel burning device and intake air leading to the fuel burning device, the air heater comprising:

a housing;

a generally cylindrical heat exchange matrix in the form of a drum surrounded by the housing, said drum and housing being relatively rotatable, one with respect to the other;

a hot end of the drum defined by the introduction of the discharge gas;

a cold end of the drum defined by the exit of the discharge gas;

the sealing structure comprising:

deformable sector plates which divide said housing into an air intake half and a gas discharge half, said sector plates being located at the hot and cold ends of the drum wherein a gap is formed between the drum and said sector plates to allow relative rotation between the drum and said sector plates;

deflection governing struts coupled with said sector plates at the hot and cold ends and extending thereacross, said struts being bendable in response to thermal deflections of said drum to cause the sector plates to bend into shapes corresponding with the thermal deflections of the drum;

circumferential rings corresponding to the hot and cold ends, respectively, and connected to radially outward ends of said struts; and guides fixed to the drum, said guides engaging said rings;

wherein said struts are deformed in an approximate partially spherical curvature which corresponds to an approximate partially spherical curvature of the drum caused by thermal deflections during heating of the air heater, said deformable sector plates being likewise deformed under the influence of said struts in an approximate spherical curvature to constantly maintain the gap during temperature changes of the air heater.

8. A method of effecting a seal between a drum and deformable sector plates of an air heater the method comprising the steps of:

forcing the ends of a deflection governing strut to follow the movement of the periphery of the drum relative to the center of the drum by coupling the strut to the drum in a way which permits relative rotary movement between the strut and drum but does not permit axial movement therebetween;

bending the strut into a shape corresponding with the shape assumed by an adjoining end of the drum due to thermal deflections of the drum as it undergoes temperature changes and is subjected to thermal differentials, said bending step occurring as a result of and concurrently with said forcing step;

moving the deformable sector plates and forming them into a shape corresponding to the shape assumed by the adjoining end of the drum due to thermal deflections and differentials, said moving step being carried out as a result of coupling of the deformable sector plates to the struts and constraining the deformable sector plates to deform into a shape dictated by the bending of the struts, and thereby;

maintaining a substantially constant clearance between the drum and sector plates by ensuring that the deformation of the sector plates follows the thermal deformations of the drum.

9. A method as defined in claim 8, wherein the thermal deflections of the drum as it undergoes temperature changes cause the ends of the drum to move between flat configurations when cold to approximately partial spherical shapes when hot and wherein said bending step includes bending the strut into a curved shape corresponding to the approximately partial spherical shape of the end of the drum.

10. A method as defined in claim 9, wherein said bending step entails displacing regions of the strut adjacent the strut ends more than regions of the strut adjacent its center.

11. A sealing structure for an air heater, the air heater effecting a heat exchange between discharge gases from a fuel burning device and intake air to the fuel burning device, the discharge gases and intake air flowing to and from the air heater via ducts, the air heater comprising:

a housing;

a generally cylindrical heat exchange matrix in the form of a drum surrounded by the housing, said drum and housing being relatively rotatable, one with respect to the other;

a hot end of the drum defined by the introduction of the discharge gas;

a cold end of the drum defined by exit of the discharge gas, said drum deforming in response to a change in temperature of the drum;

a set of sector plates which divide said housing into an air intake half and a gas discharge half, said sector plates being located at the hot and cold ends of the drum;

means to deform said sector plates in response to the deformation of said drum;

circumferential rings corresponding to the hot and cold ends, respectively, and connected to radially outward ends of said sector plates;

a set of flexible, hollow expansion joints in said housing for providing gapless flow paths between, on the one hand, the ducts carrying the discharge gases and intake air to and from the air heater and, on the other hand, the sector plates and circumferential rings, each expansion joint having an inner end which is sealingly coupled to at least one sector plate and to a circumferential ring to create the gapless flow paths.

* * * * *

UNITED STATES PATENT AND TRADEMARK OFFICE

CERTIFICATE OF CORRECTION

PATENT NO. : 5,038,849

DATED : August 13, 1991

INVENTOR(S) : DONALD K. HAGAR

It is certified that error appears in the above-identified patent and that said Letters Patent is hereby corrected as shown below:

Column 2, line 62, "continuous: perimeter" should read --continuous perimeter--.

Column 5, line 19, "stowing" should read --showing--.

Column 8, line 26, "48" should read --48'--.

Column 8, line 30, "48," should read --48'--.

Column 8, line 36, "ring is" should read --ring 101a is--.

Column 10, line 54, "70" should read --70'--.

Column 10, line 55, "48" should read --48'--.

Column 11, line 18, "16," should read --16'--.

Column 11, line 29, "of towards the drum" should read --of drum--.

Column 12, line 6, "98" should read --98'--.

Column 13, line 54, "cutward" should read --outward--.

UNITED STATES PATENT AND TRADEMARK OFFICE

CERTIFICATE OF CORRECTION

PATENT NO. : 5,038,849

DATED : August 13, 1991

INVENTOR(S) : DONALD K. HAGAR

It is certified that error appears in the above-indentified patent and that said Letters Patent is hereby corrected as shown below:

Column 14, line 16, "drum" should read --drum,--.

Signed and Sealed this

Second Day of November, 1993

*Attest:*

Bruce Lehman

BRUCE LEHMAN

*Attesting Officer*

*Commissioner of Patents and Trademarks*